US006158629A

United States Patent [19]

Abplanalp et al.

[11] Patent Number: 6,158,629

[45] **Date of Patent: *Dec. 12, 2000**

[54] GASKETED AEROSOL MOUNTING CUP

[76] Inventors: Robert Henry Abplanalp, Ten Hewitt Ave., Bronxville, N.Y. 10708; Charles S. Radtke, 37 Beach St., Little Ferry, N.J. 07643

[ * ] Notice: This patent issued on a continued prosecution application filed under 37 CFR 1.53(d), and is subject to the twenty year patent term provisions of 35 U.S.C. 154(a)(2).

[21] Appl. No.: 08/867,609

[22] Filed: Jun. 2, 1997

Related U.S. Application Data

[63] Continuation of application No. 08/512,533, Aug. 8, 1995, abandoned.

[51] Int. Cl.[7] ..... B65D 83/00

[52] U.S. Cl. ..... 222/402.1; 277/206 R

[58] Field of Search ..... 222/402.1; 272/206 R

[56] References Cited

U.S. PATENT DOCUMENTS

| | | | |
|---|---|---|---|
| 4,065,026 | 12/1977 | Williams et al. | 277/206 R X |
| 4,348,032 | 9/1982 | Hanson et al. | 277/206 R X |
| 4,971,224 | 11/1990 | Scremin | 222/402.1 X |
| 5,226,573 | 7/1993 | Brugerolle et al. | 222/402.1 |

*Primary Examiner*—Joseph A. Kaufman
*Attorney, Agent, or Firm*—Kilgannon & Steidl

[57] ABSTRACT

An improved gasketed mounting cup for an aerosol container wherein the gasket is a folded-over and hinged sleeve gasket; said gasket being used as an alternative to the cut-type gasket. In the preferred version the hinge is distal to the body portion of the mounting cup. There is also provided a method for forming the improved gasketed mounting cup, as well as a novel punch for forming the folded-over or hinged gasket.

12 Claims, 7 Drawing Sheets

GASKETED AEROSOL MOUNTING CUP

This is a continuation of Ser. No. 08/512,533, filed on Aug. 8, 1995 (now abandoned).

BACKGROUND OF THE INVENTION

This invention generally relates to valve mounting assemblies for aerosol containers, said mounting assemblies being commonly referred to as "mounting cups." More particularly, this invention relates to an improved gasket for the mounting cup, i.e., the gasket that forms the seal between the perimetal rim of the mounting cup and the bead of the aerosol container, wherein the sleeve gasket is folded over an itself to provide a double thickness of gasket material disposed within the channel portion of the mounting cup. Also, the invention relates to a method and apparatus for forming the folded-over gasket after the gasket material has been disposed on the mounting cup.

Aerosol containers are widely used to package a variety of fluid materials, both liquid and powdered particulate products. Typically, the product and a propellant are confined within the container, at above atmospheric pressure, and the product is released from the container by manually opening a dispensing valve to cause the pressure within the container to deliver the product through the valve and connecting conduits to a discharge orifice.

The dispensing valve, crimped to a mounting cup having a sealing gasket, is normally mounted in a top opening of the container, which opening is defined by a component commonly referred to as the "bead" of the container opening. The mounting cup includes a central pedestal portion for crimping the dispensing valve, a profile portion extending outward from the pedestal portion, which profile portion merges into an upwardly extending body portion, the body portion emerging into a hemispherically-shaped channel portion terminating in a skirt portion, which channel is configured to receive the bead portion of the container opening. The sealing gasket normally is disposed within the channel portion and in many gasket configurations extends downward along a part of the body portion. After the sealing gasket is disposed onto the mounting cup, the cup is positioned onto the container and the cup is clinched to the container. The clinching operation is well-known to those skilled in the aerosol container art.

In an aerosol container, an effective seal between the mounting cup and the container bead is obviously critical. This seal is accomplished through the sealing gasket, which must prevent the loss of pressure (propellant) through the interface between the container bead and mounting cup.

Various types of sealing gaskets are known in the art. One common type of gasket comprises a conventional flat rubber gasket that is placed inside the channel of the mounting cup. Gaskets of this type are typically manufactured by extruding, molding and vulcanizing the compounded rubber mixture onto rods and then cutting or slicing off thin, annular sections of the extruded and vulcanized product (tube). These gaskets are often referred to as cut or flat gaskets. Cut gaskets are relatively expensive to manufacture. It is very difficult to control precisely the radial dimensions of the tubes, from which the cut gaskets are made, the tubes having varying dimensions and being out of round. Consequently, the outer cylindrical surfaces of these tubes are usually machined to the desired dimensions, said matching adding considerable cost to the gasket manufacture.

Another type of gasket comprises a relatively thin sleeve of elastomeric material that is mounted on the body portion of the mounting cup and then advanced along said body so that the gasket extends ultimately into a limited portion of the annular channel of the mounting cup as well as downward along the body portion beyond the annular clinch zone. When the mounting cup is mounted and then clinched onto the aerosol container, the sealing gasket is forced into a sealing engagement with both the channel of the mounting cup and the bead of the container. Typically, these gaskets are forced into a sealing engagement with the mounting cup along only a relatively small circumferential portion of the gasket at positions referred to as the 5 o'clock and 11 o'clock positions. Due to their shape, gaskets of this type are often referred to as sleeve gaskets.

Sleeve gaskets are manufactured by advancing a tube of gasket material onto the body of the mounting cup and then cutting or slicing off annular sections of the tube. The axial heights of sleeve gaskets, however, are substantially greater than the axial heights of cut gasket. Sleeve gaskets are much less expensive to make and assemble to the mounting cup than cut gaskets. When making sleeve gaskets, it is not necessary to machine the outside cylindrical surface of the extruded tubes of gasket material. Moreover, a tubular sleeve gasket may be assembled to the mounting cup more easily than assembling a cut gasket to the mounting cup.

The sealing gasket may also be formed by a liquid material containing water or solvent that is deposited on the annular channel and body portion of the mounting cup. The solvent or water evaporate during curing and the remaining material produces a resilient sealing material in the mounting cup channel. Forming the gasket from a liquid material also is a comparatively expensive procedure requiring multiple production steps including the use of curing ovens or other means to dry and cure the gasket material. Moreover, means must be provided for rotating the mounting cup beneath and relative to a metering apparatus that dispenses carefully determined amounts of a gasket forming composition. These gaskets are commonly referred to as "flowed-in" gaskets. The "flowed-in" gasket system has been disfavored recently due to environmental concerns.

Thus, the above described types of gaskets, as well as others that may be used, have both advantages and disadvantages. Both cut and sleeve gaskets generally produce excellent sealing results. Cut gaskets have seen widespread commercial use for a longer period of time than sleeve gaskets. When using sleeve gaskets on filling and clinching equipment previously used with flat or cut gaskets, a time consuming adjustment is necessary to the clinching tool. Often, a clinching line will be required to accommodate both flat and sleeve gaskets, depending on the gasket specifications of the valved container being clinched. To avoid having to make the clinching tool adjustment, and the consequent down-time, there has been a tendency, particularly in Europe, to stay with flat or cut gaskets, even though such gaskets are more costly.

In the past, an attempt has been made to overcome the disadvantages of a cut gasket by converting a specially dimensioned sleeve-type gasket into a cut-type gasket. This attempt is described in U.S. patent application Ser. No. 08/384,736, filed on Feb. 3, 1995, now abandoned. A disadvantage of utilizing the aforementioned sleeve to cut-type gasket is that the apparatus used to manufacture the sleeve-type gasket is designed to handle tubing having a thickness on the order of 0.014". Cut gaskets generally are 0.040" thick, and to manufacture sleeve-type gasket material for conversion into a cut-type gasket of 0.040" or more requires a significant retooling.

SUMMARY OF THE INVENTION

An object of this invention is to provide an improved gasketed mounting cup for aerosol containers, an improved method for assembling the gasket to the mounting cup and novel apparatus for forming the gasket of this invention.

Another object of the present invention is to provide a mounting cup for an aerosol container with a sealing gasket that has the manufacturing cost advantages of a sleeve gasket and the advantages of the thickness of a cut gasket in the clinching operation of the aerosol container.

These and other objectives are attained through use of the gasketed mounting cup, the method and apparatus of this invention.

In its broadest aspect, as an article of manufacture, the gasketed mounting cup of this invention comprises a sleeve-type gasket that has been folded onto itself to provide a gasket having a double thickness, i.e., a thickness equal to the under portion and the folded-over portion.

In a more narrow aspect, the gasket of this invention comprises a sleeve-type gasket that has been folded onto itself to provide a cut-type gasket in such manner that the fold is disposed at the terminus of the gasket distal to the body portion of the mounting cup.

In the broadest aspect of the method of this invention, the gasket of this invention is formed by advancing the gasket material in the form of a sleeve along the body portion and into the channel portion of the mounting cup and thereat advancing a tool that creates an annular line of compressive force against the gasket thereby causing a fold line in the gasket with the result that the portion of the gasket distal to the body portion of the mounting cup folds over on the other portion of the gasket material.

The apparatus of this invention is a punch having an outside nose portion that will upon compressive movement against the gasket material effect a notching in the gasket material, and said punch further having a step or shoulder for advancing the sleeve gasket along the body of the body portion of the mounting cup into the channel portion. A preferred form of the nose of the punch is to have a series of annular serrations at the outside nose portion.

Returning to the gasketed mounting cup of this invention, after the outer portion of the gasket has been folded onto the inner portion, at the point where the gasket is partially in the channel, the gasket is then urged further into the channel portion of the mounting cup. In the instance where the channel portion of the mounting cup is flat, the gasket will be disposed against the flat surface of the bottom of the channel. In the instance where the channel portion of the mounting cup is rounded or curvilinear in shape, the gasket is disposed diagonally within the channel portion with the free edges of the gasket contiguous to the body portion of the mounting cup. With the rounded or curvilinear channel portion, the insertion of the bead of the container into the channel portion advances the gasket to conform to and against the curvilinear shape of the channel portion of the mounting cup.

Therefore, the sleeve gasket of this invention is initially positioned onto the body portion of the mounting cup. The sleeve gasket of this invention is cut from an extruded tube of gasket material. After cutting, the sleeve gasket is then partially advanced along the body portion of the mounting cup and then further advanced into the annular channel thereof in two separate steps. The clinching of the mounting cup and container then occurs.

Further benefits and advantages of the invention will become apparent from a consideration of the following detailed description given with reference to the accompanying drawings which specify and show preferred embodiment of the invention.

DETAILED DESCRIPTION OF THE PREFERRED EMBODIMENTS

Figure 1:
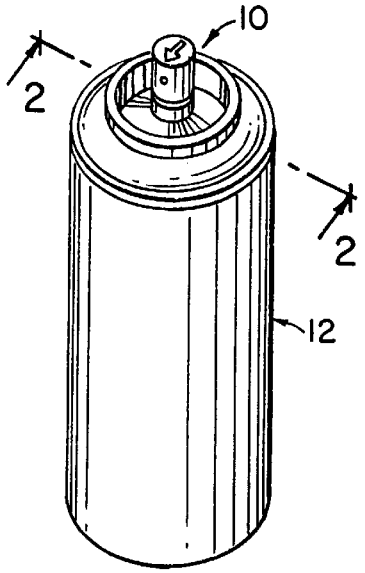
FIG. 1 is a perspective view of a gasketed mounting cup of this invention clinched to an opening in an aerosol container.
Figure 2:
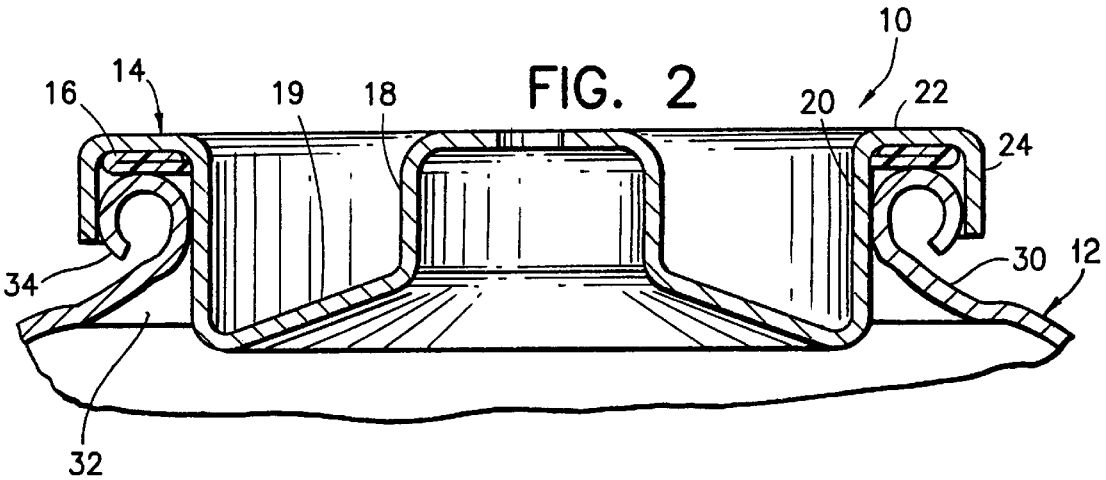
FIG. 2 is a cross-sectional view of the gasketed mounting cup of this invention and a partial cross-sectional view of the aerosol container along the line 2—2 of FIG. 1.

FIGS. 1 and 2 illustrate a valve mounting assembly, generally shown at 10, positioned within the open end 32 of a container 12. More specifically, valve assembly 10 (valve unit now shown) includes a mounting cup, generally designated as 14, and gasket 16. The mounting cup, in turn, includes a pedestal portion 18, a profile portion 19, and a body portion 20 terminating in a radially outwardly channel portion 22 that receives the gasket 16, the channel portion 22 terminating in the skirt 24. Container 12 includes upper portion 30 that forms central container opening 32 and an upper rolled rim or bead 34 that extends around opening 32. As shown in FIG. 2, channel 22 of cup 14 is mounted on and receives bead 34. Gasket 16 is disposed between bead 34 and the under surface of channel 22. The bead 34 directly supports the valve mounting assembly 10.

Again, with reference to FIG. 2, in order to connect assembly 10 permanently to container 12, a portion of the body 20 is forced radially outward, underneath bead 34, around the circumference of body 20 thereby clinching the mounting assembly 10 to container 12. This clinching operation also forces gasket 16 into a tight pressure fit against both bead 34 and the undersurface of channel 22, thereby forming an effective seal therebetween. The clinching operation is well known to those skilled in the art.

Figure 3A:
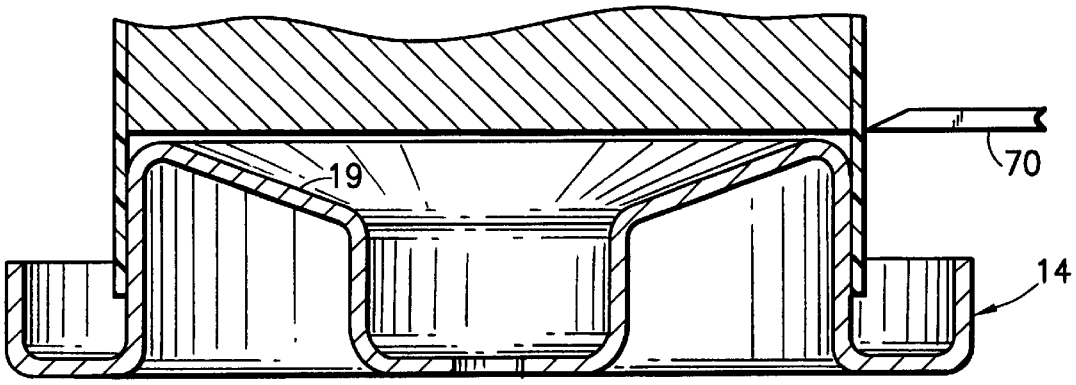
FIGS. 3A–3F are schematics showing the several steps involved in effecting the fold-over of the gasket material of this invention in conjunction with a mounting cup having a flat channel portion.
Figure 4A:
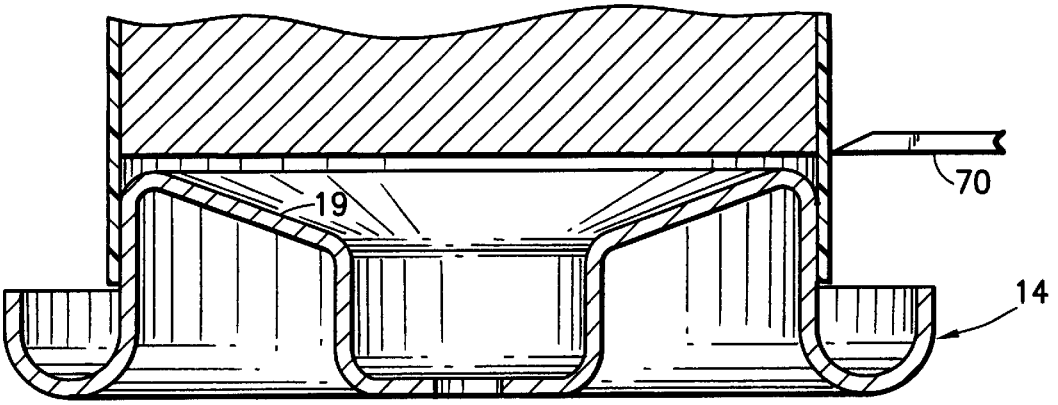
FIGS. 4A–4G are schematics showing the several steps involved in effecting the fold-over and ultimate positioning of the gasket material of this invention in conjunction with a mounting cup having a curvilinear channel portion.

The gasket configuration and positioning of this invention is formed in a series of steps commencing with the positioning of a portion of a tubular gasket material onto the body portion of an already formed mounting cup. Subsequently, the tubular portion of gasket material is cut by cutter 70 to provide a mounting cup having a sleeve of tubular gasket material extending slightly above the profile portion 19 of the mounting cup. See FIGS. 3A and 4A.

Figure 3B:
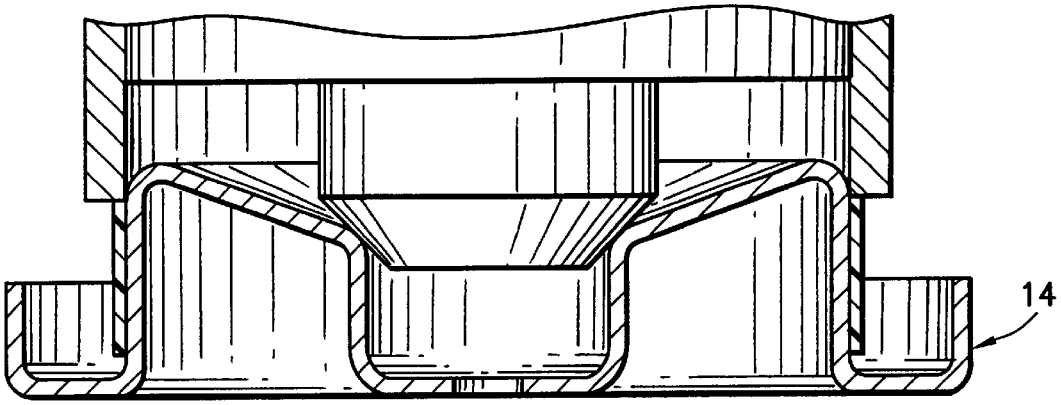
Figure 3C:
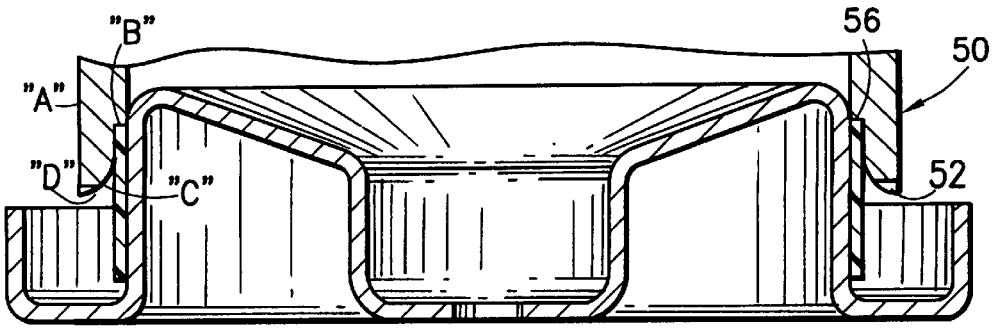
Figure 3D:
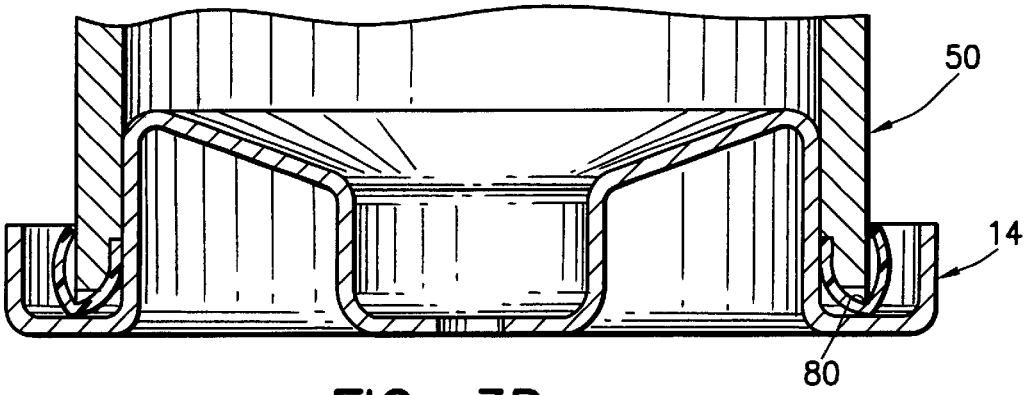
Figure 4B:
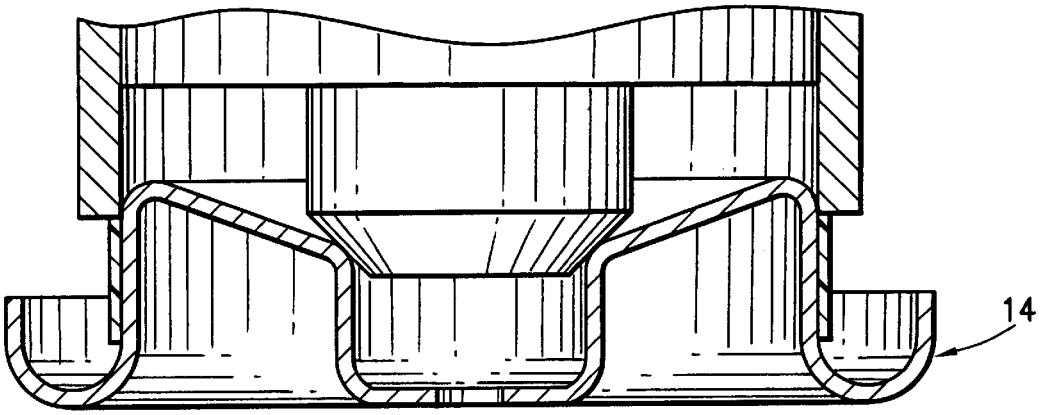

After cutting the gasket, the gasket is partially advanced onto the body portion of the mounting cup by a suitable punch to the position shown in FIGS. 3B and 4B. At this point, the gasket is advanced further on the body portion and into the channel portion by a punch 50 having a relatively sharp nose portion. Details of the punch construction for ultimately positioning the sleeve gasket are described hereafter. By bottoming the relatively sharp nose portion of the punch against the gasket now in the channel of the mounting cup, with the mounting cup and its supporting member offering an opposing resistance to the force of the punch, a fold line 80 is created in the sleeve gasket which results in the portion of the gasket extending outwardly from the fold line folding onto the portion of the gasket extending inwardly toward the body portion of the mounting cup. The steps of advancing the sleeve gasket within the channel portion of the mounting cup and bottoming the sharp-nosed punch against the gasket within the channel portion of the mounting cup are schematically shown in FIGS. 3C and 3D and 4C and 4D.

Note should be made of the different configurations of the channel portion of the mounting cups shown in FIGS. 3A–3F and 4A–4G. In the FIG. 3 series, the channel portion of the mounting cup is flat, whereas, the channel portion of the FIG. 4 series is curvilinear or rounded. With the flat channel, the punch 50 shown in FIG. 3D is retracted and the mounting cup moved to a station whereat the flat bottom punch 60 shown in FIG. 3F advances to flatten the folded-over gasket. As shown in FIG. 3F, the ultimate positioning punch 60 advances the gasket against the flat surface of the channel. This is not critical. It is important, however, particularly where the mounting cup/aerosol container is to be pressure filled, i.e., where the propellant is introduced to the container by introducing the propellant by vacuum evacuation of the air in the container through a space between the mounting cup and the bead of the container, that the folded gasket not extend beyond the terminal edge of the skirt portion of the mounting cup. Therefore, the folded gasket in the flat-type channel may be positioned within the channel short of bottoming at the flat bottom of the channel, though it is shown in FIG. 3F as bottomed against the flat surface at the bottom of the channel.

The corresponding sequence of steps in forming the gasket of this invention within the curvilinear channel of a mounting cup is schematically shown in FIGS. 4A–4F, FIG. 4G showing the ultimate position of the gasket in a curvilinear cup after the bead of the aerosol container has seated the gasket to the contour of the channel and prior to clinching the container and mounting cup. As with the flat bottom channel configuration, it is important that the folded-over gasket be disposed within the channel beneath the terminal free edge of the skirt of the mounting cup for the reasons discussed above.

Figure 4C:
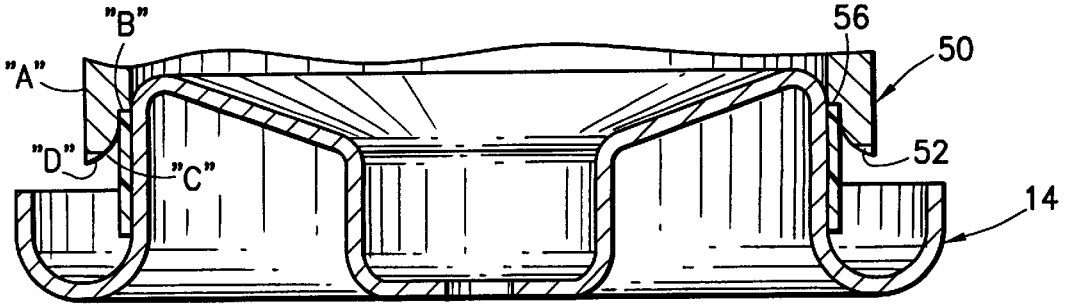
Figure 4D:
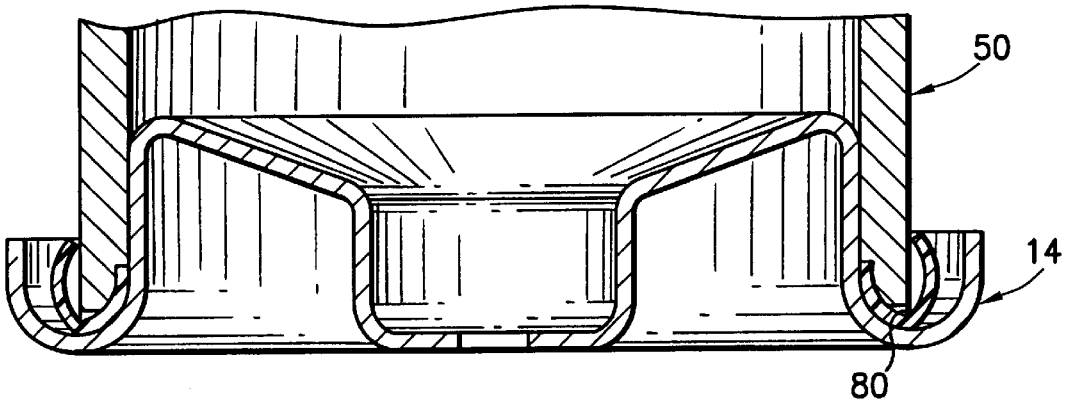
Figure 4E:
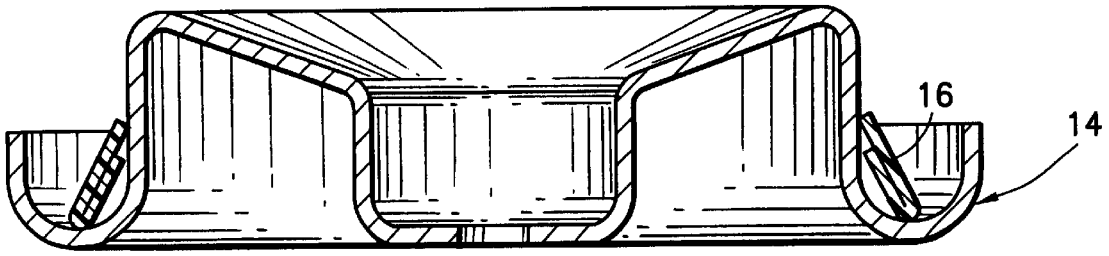
Figure 4F:
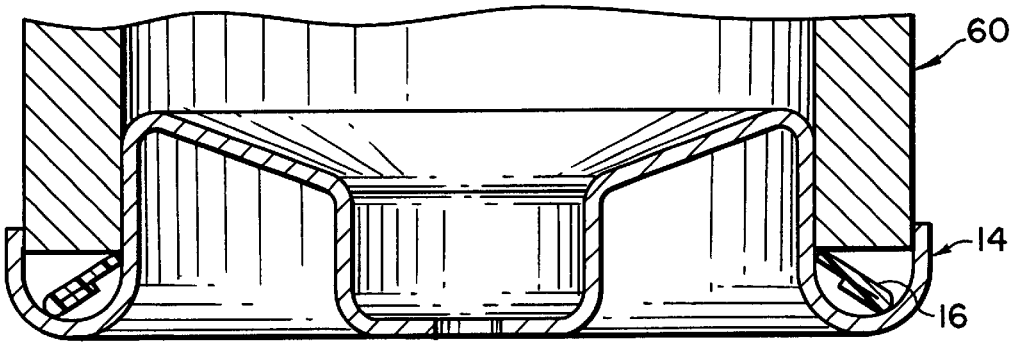
Figure 4G:
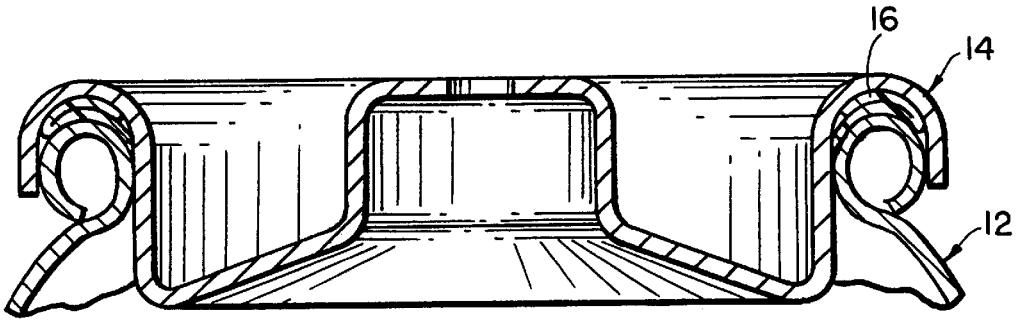

Moreover, in the rounded or curvilinear-type channel portion, the gasket is moved further within the channel to a position such as shown in FIG. 4F, i.e., in a diagonal profile extending from the body portion diagonally downward toward the skirt portion of the mounting cup. With the curvilinear channel, the flat punch 60 is not used to bottom out the gasket and, thus, it is important to displace the gasket some distance along the body of the mounting cup to avoid, in addition to the propellant filling problem discussed above, an inversion of the top and bottom layers of the gasket.

It is desirable that the segment of the gasket, extending from the fold line to the terminus of the gasket distal to the body portion of the mounting cup, fold onto the segment of the mounting cup that extends from the fold line to the terminus of the gasket contiguous to the body portion of the cup. With such a fold-over relationship, i.e., having the fold line of the gasket distal to the body portion, any deviation from satisfactory clinching of the mounting cup and the bead of the container that might normally produce a leak path for propellant might well be sealed by forcing one segment of the gasket, as shown, for example, in FIGS. 3F and 4G, against the underside of the channel portion of the mounting cup and the other segment of the gasket against the bead of the container through capture of the leaking propellant at the fold between the gasket layers. Obviously, if the fold line of the layered gasket were reversed, i.e., the fold-line were contiguous to the body of the mounting cup, a loose crimp would result in the propellant by-passing the gasket and exiting either between the gasket and mounting cup or between the gasket and the container bead, or both.

The apparatus for conducting the Steps 3A–3B and 4A–4B is described in U.S. Pat. No. 4,546,525, issued Oct. 15, 1985; the disclosure of said U.S. patent being incorporated by reference herein.

The steps of FIGS. 3C–3D and 4C–4D are carried out by mounting a punch 50 (See FIG. 3C) having a serrated nose 52 (see FIG. 7) on a suitable reciprocating ram (not shown). It has been found satisfactory in carrying out the Steps of 3C–3D and 4C–4D to place the inverted mounting cup of FIGS. 3B and 4B atop a piston surface (not shown) that moves within a four inch (4") cylinder. The cylinder is charged to 20 psi to create a resistive force of 250-plus lbs. against the advancing serrated punch.

In the preferred form, the radial thickness of the gasket material, such as is shown in FIGS. 3C and 4C, is twenty thousands of an inch (0.020"). When the segments of the gasket are folded on each other, the composite thickness of the gasket is forty thousands of an inch (0.040"), this being the thickness of the standard cut-type gasket. The length of the gasket, as shown for example in FIGS. 3C and 4C, is two hundred sixty thousands of an inch (0.260") in the case of the flat bottom channel and two hundred thousands of an inch (0.200") in the case of the curvilinear channel. It is most desirable, particularly in the case of the rounded or curvilinear shaped channel portion of the mounting cup, that the lower segment of the gasket (when the mounting cup is in the inverted position as in FIGS. 4E–4F) be shorter than the top segment. For a curvilinear mounting cup it has been found that a bottom segment of seventy-five thousands of an inch (0.075") produces a gasketed mounting cup having excellent sealing characteristics when the mounting cup is crimped to the aerosol container.

In the instance of flat bottom mounting cups, the top and bottom segments may be of the same length and should fit into the flat bottom between the side walls as shown in FIG. 3F.

Figure 5:
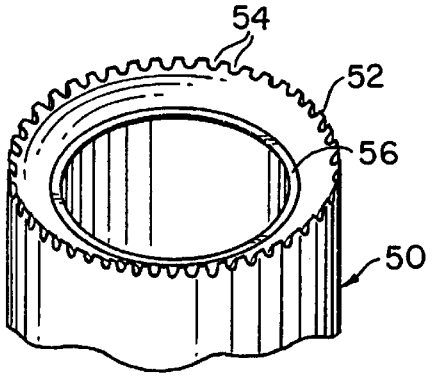
FIG. 5 is a partial perspective view of the serrated punch of this invention.
Figure 6:
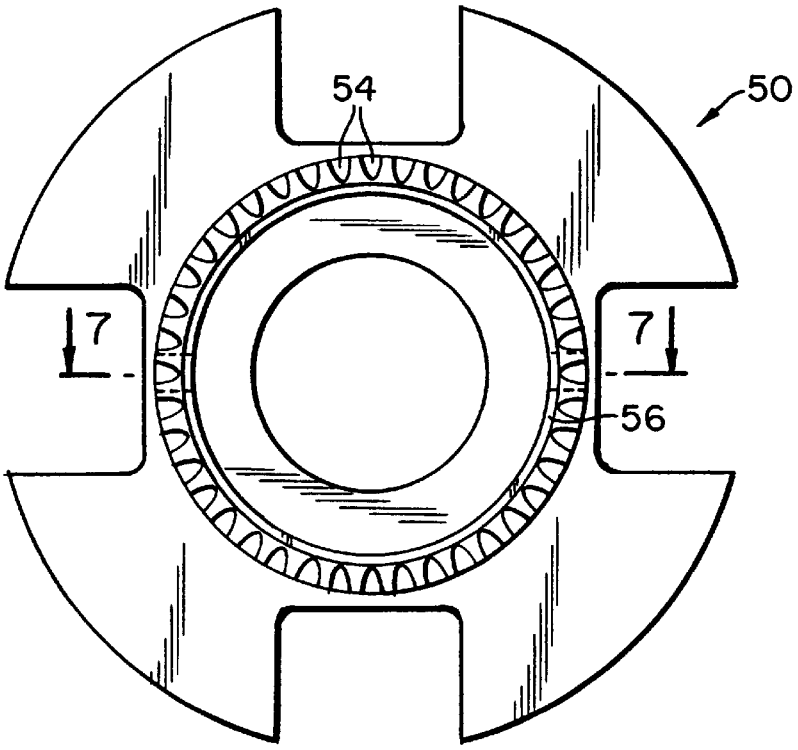
FIG. 6 is a bottom view of the serrated punch of this invention.
Figure 7:
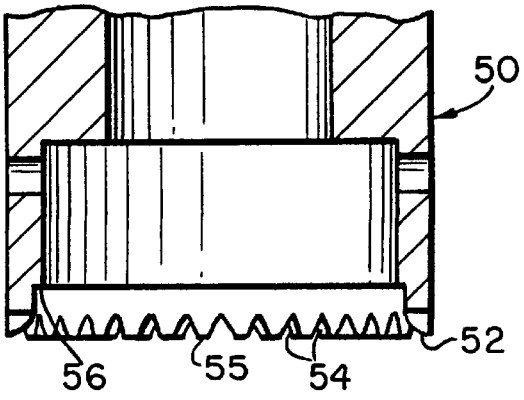
FIG. 7 is a partial cross-sectional view of the serrated punch of this invention through the line 7—7 of FIG. 6.

FIGS. 5–7 show structural detail of a serrated punch used to carry out Steps 3C–3D and 4C–4D of the method of this invention.

In FIG. 5, the punch generally designated as 50, has a leading nose portion 52 having a plurality of serrations 54 angularly about the nose portion 52. Above the nose portion 52 and radially inward on the punch is the step or shoulder 56 which engages the gasket material, as shown in FIGS. 3C and 4C, to advance the gasket material into the channel portion of the mounting cup to the position shown in FIGS. 3D and 4D and thereat bottom the serrations of the punch against the gasket material and create at the annular zone of contact a fold-over hinge that allows the segment of the gasket material extending radially beyond the hinge to inherently fold over against the segment of gasket material contiguous to the body portion of the mounting cup when the serrated punch is withdrawn. The serrations, as shown in FIG. 7, each have a flat bottom, sharp edge 55.

Figure 3E:
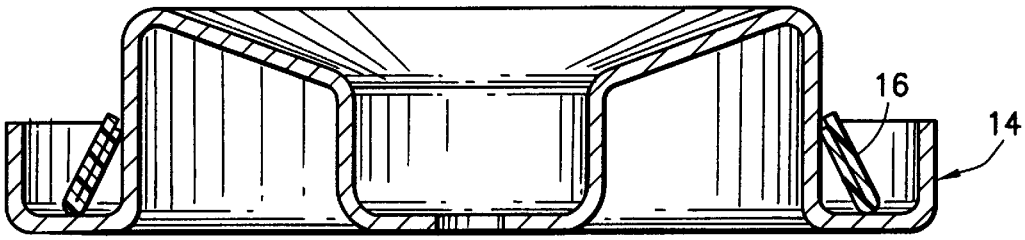
Figure 3F:
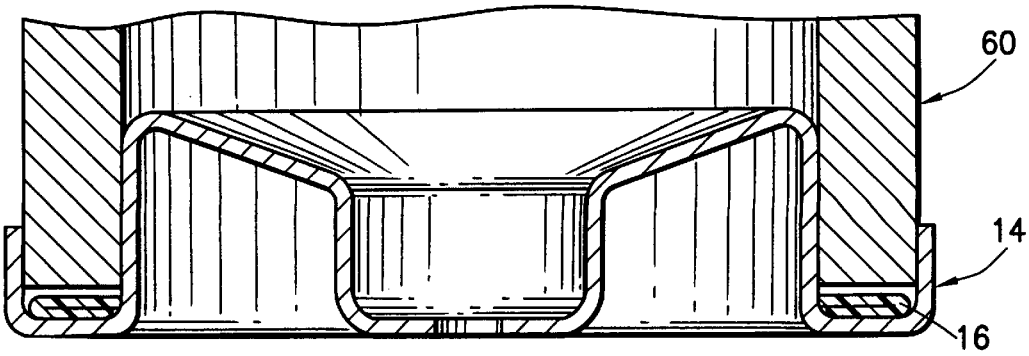

While the action of the compressive force by the nose of the punch against the gasket material creates a fold-over line or hinge, as described above, it is conceivable that a punch may be operated to cut through the gasket material and thereby form two distinct superimposed segments, generally as shown in FIGS. 3E & 4E, but without the hinge. Such an embodiment may also result in adequate sealing.

It has been found that a serrated punch having the following dimensions is satisfactory to provide the fold-over gasket of this invention having excellent sealing characteristics.

Referring to FIG. 3C (flat channel) of the drawings:

1) "A" is the outside diameter of the serrated punch and it is 1.130";
2) "B" is the step or shoulder in the punch, and the vertical wall below the step or shoulder has a diameter of 1.038"; the axial depth between the shoulder and the bottom of the punch nose being 0.090";
3) The nose radius "C"is 0.040";
4) The pinch radius at the deepest edge of the serrated nose "D" is 0.025"; and
5) The outside diameter of the body portion of the mounting cup is 0.989", and the inner diameter of the punch above the serrated step if 0.995";

Referring to FIG. 4C (rounded or curvilinear channel) of the drawings:

1) "A" is the outside diameter of the serrated punch and it is 1.108";
2) "B" is the step or shoulder in the punch, and the vertical wall below the step or shoulder has a diameter of 1.038"; the axial depth between the shoulder and the bottom of the punch nose being 0.090";
3) The nose radius "C"is 0.035";
4) The pinch radius of the deepest edge of the serrated nose "D" is 0.020"; and
5) The outside diameter of the body portion of the mounting cup is 0.989", and the inner diameter of the punch above the serrated step if 0.995".

The apparatus for advancing the gasket material from the position shown in FIGS. 3E and 4E is a flat-bottom punch, generally designated as 60, as shown in FIGS. 3F and 4F. The punch used in FIGS. 3F and 4F has an outside diameter of 1.230 and an inside diameter of 0.995".

The serrated nose of the punch 50 described above has 40 serrations 54. The serrations are spaced 9° apart at the apex. The width of the flat of the serrations at the leading edge of the nose of the punch is approximately 0.040", the angle of the side walls of the serration is 60° included and the height of the serration is 0.040" to a sharp corner.

Mounting cups of the type described above are well known in the art, and cups may be made in any appropriate procedure and from any suitable material. For instance, cups may be made of metal such as steel, aluminum, and the like and formed into the desired shape through a stamping process.

Gasket material useful in this invention may be a polyolefin such as, for example, polyethylene (PE) and polypropylene (PP). Rubber modifiers such as, for example, polyisobutylene may be added to the PE and PP. A preferred gasket material is 80% linear low density polyethylene and 20% polyisobutylene (80% LLDPE/20% PIB).

If desired, the tubular gasket material may have coated on one or both surfaces an adhesive compound that is activatable after the gasket material has been disposed in its alternately desired position. Adhesive materials that have a delayed activation are well known to those skilled in the art.

There are many advantages to forming the gasket of this invention from sleeve-type gaskets. Among the advantages are:

a) Cost Reduction:
   1) eliminates machine cutting of cut gaskets;
   2) assembly at higher speeds using sleeve gasket assembly technology;
   3) tubing is extruded without required O.D. machining.
b) Superior Gasket Retention: Cut gaskets of the prior art have a tendency to become dislodged from the mounting cup during the handling operations prior to clinching of the gasketed mounting cup. The gaskets of this invention show a marked improvement in stability on the mounting cup. The folding of the gasket at the hinge results in the top segment (e.g. as shown in FIGS. 4E and 4F) being highly stretched and thereby acting to maintain the gasket on the mounting cup.
c) Sleeve gaskets provide a much broader selection in materials of construction, including blends of materials, than do the cut gaskets of the prior art.
d) Eliminates dust common to machine cutting gaskets.
e) Eliminates problems due to warpage in the cut gaskets of the prior art.
f) With rubber cut gaskets, the industry experiences a so-called "squeeze out" problem familiar to those skilled in the art.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

We claim:

1. In a gasketed valve mounting assembly for an aerosol container comprising a mounting cup having a central pedestal portion for affixing an aerosol valve, a profile portion emerging outward from the pedestal, a body portion extending upwardly from the outward terminus of the profile portion and terminating in a channel portion for receiving the bead of a container, said channel portion having an under surface, and terminating in a skirt portion, the improvement comprising disposing a gasket in the channel portion of the mounting cup which gasket has dual overlapping segments joined by a continuous annular fold line or hinge, said annular fold line or hinge being distal to the body portion of the mounting cup when the mounting assembly is joined in a sealing relation with an aerosol container.

2. The improvement of claim 1 and further wherein the contour of the channel portion of the mounting cup is flat.

3. The improvement of claim 2 and further wherein the segment of the gasket nearest to the under surface of the channel portion is shorter than the other gasket segment.

4. The improvement of claim 3 and further wherein the gasket is disposed against the flat bottom of the channel portion of the mounting cup prior to the clinching of the mounting cup to the aerosol container.

5. The improvement of claim 1 and further wherein the channel portion of the mounting cup is round or curvilinear.

6. The improvement of claim 5 and further wherein the segment of the gasket nearest to the under surface of the channel portion is shorter than the other gasket segment.

7. The improvement of claim 1 and further wherein the segment of the gasket nearest to the under surface of the channel portion is shorter than the other gasket segment.

8. The improvement of claim 1, and further wherein the combined thickness of the gasket segments is substantially 0.040".

9. The improvement of claim 1, and further wherein the gasket segments do not extend below the annular clinching zone of the mounting cup and the bead of the aerosol container.

10. The improvement in the gasketed mounting cup of claim 1, and further wherein the gasket is comprised of a polyolefinic polymer modified with a rubber modifier.

11. The improvement in the gasketed mounting cup of claim 1, and further wherein the gasket is comprised of a polyolefinic polymer selected from the group consisting of linear low density polyethylene and linear low density polypropylene and the rubber modifier is polyisobutylene.

12. The improvement of claim 11, and further wherein the gasket is comprised of approximately 80% linear low density polyethylene and approximately 20% polyisobutylene.

* * * * *